US008597500B2

(12) United States Patent
Xu et al.

(10) Patent No.: US 8,597,500 B2
(45) Date of Patent: Dec. 3, 2013

(54) PROCESS FOR CONVERTING INFERIOR FEEDSTOCK TO HIGH QUALITY FUEL OIL

(75) Inventors: Youhao Xu, Beijing (CN); Lishun Dai, Beijing (CN); Zhigang Zhang, Beijing (CN); Shouye Cui, Beijing (CN); Jianhong Gong, Beijing (CN); Chaogang Xie, Beijing (CN); Jun Long, Beijing (CN); Hong Nie, Beijing (CN); Zhijian Da, Beijing (CN); Jiushun Zhang, Beijing (CN); Tao Liu, Beijing (CN); Anguo Mao, Beijing (CN)

(73) Assignees: China Petroleum & Chemical Corporation, Beijing (CN); Research Institute of Petroleum Processing, SINOPEC, Beijing (CN)

( * ) Notice: Subject to any disclaimer, the term of this patent is extended or adjusted under 35 U.S.C. 154(b) by 451 days.

(21) Appl. No.: 12/921,436

(22) PCT Filed: Mar. 13, 2009

(86) PCT No.: PCT/CN2009/000272

§ 371 (c)(1),
(2), (4) Date: Sep. 8, 2010

(87) PCT Pub. No.: WO2009/111953

PCT Pub. Date: Sep. 17, 2009

(65) Prior Publication Data

US 2011/0000818 A1 Jan. 6, 2011

(30) Foreign Application Priority Data

Mar. 13, 2008 (CN) ..... 2008 1 0101854
Oct. 31, 2008 (CN) ..... 2008 1 0225606

(51) Int. Cl.
*C10G 11/00* (2006.01)

(52) U.S. Cl.
USPC ..... 208/113

(58) Field of Classification Search
USPC ..... 208/70, 113, 103, 106
See application file for complete search history.

(56) References Cited

U.S. PATENT DOCUMENTS 2,623,004 A * 12/1952 Shalit ..... 208/96
3,702,886 A 11/1972 Argauer et al.

(Continued)

FOREIGN PATENT DOCUMENTS

CN 1232069 A 10/1999
CN 1232070 A 10/1999

(Continued)

OTHER PUBLICATIONS

"Oil and Gas Journal" International Petroleum News and Technology, vol. 106, 34, Sep. 8, 2008.*

(Continued)

*Primary Examiner* — Randy Boyer
*Assistant Examiner* — Juan Valencia
(74) *Attorney, Agent, or Firm* — Scully, Scott, Murphy & Presser, P.C.

(57) ABSTRACT

A catalytic conversion process to convert inferior feedstock to high quality fuel oil and propylene is disclosed. Inferior feedstock is introduced into first and second reactor zone, wherein first step and second step reactions occur by contacting with catalytic conversion catalyst. Product vapors include fluid catalytic cracking gas oil (FGO) which is introduced into a hydrotreating unit and/or extraction unit to obtain hydrotreated FGO and/or extracted FGO. Hydrotreated FGO and/or extracted FGO returns to the first reactor zone and/or another catalytic cracking unit to obtain propylene and gasoline. The extracted oil of said FGO is rich in double ring aromatics and the raffinate of said FGO is rich in chain alkane and cycloalkane. More particularly, the invention utilizes petroleum oil resources efficiently for decreasing the yield of dry gas and coke significantly.

20 Claims, 4 Drawing Sheets

(56) References Cited

U.S. PATENT DOCUMENTS

| | | | | |
|---|---|---|---|---|
| 5,009,769 | A * | 4/1991 | Goelzer | 208/113 |
| 5,326,465 | A * | 7/1994 | Yongqing et al. | 208/120.15 |
| 6,045,690 | A * | 4/2000 | Fujiyama et al. | 208/153 |
| 6,416,656 | B1 * | 7/2002 | Zhang et al. | 208/113 |
| 6,495,028 | B1 * | 12/2002 | Xu et al. | 208/69 |
| 2003/0121825 | A1 * | 7/2003 | Pittman et al. | 208/113 |
| 2006/0157385 | A1 * | 7/2006 | Montanari et al. | 208/49 |

FOREIGN PATENT DOCUMENTS

| | | | |
|---|---|---|---|
| CN | 1237477 | A | 12/1999 |
| CN | 1382776 | * | 4/2001 |
| CN | 1382776 | A | 12/2002 |
| CN | 1448483 | A | 10/2003 |
| CN | 1746265 | A | 3/2006 |
| CN | 1766059 | A | 5/2006 |
| CN | 1827744 | A | 9/2006 |
| CN | 1844325 | A | 10/2006 |
| CN | 1896192 | A | 1/2007 |

OTHER PUBLICATIONS

"Fluid Catalytic Cracking Handbook, Design Operation, and Troubleshooting of FCC Facilities", Second Edition pp. 196-198 (2000).

International Preliminary Report on Patentability directed to PCT/CN2009/000272 dated Mar. 13, 2009.

* cited by examiner

PROCESS FOR CONVERTING INFERIOR FEEDSTOCK TO HIGH QUALITY FUEL OIL

FIELD OF THE INVENTION

This invention relates to a catalytic conversion process of hydrocarbon oils. More particularly, the invention relates to a process for converting inferior feedstock to a large amount of high quality fuel oil.

BACKGROUND OF THE INVENTION

The quality of crude oil is getting worse as the increasingly higher exploitation quantity. The current crude oil contains a high amount of heavy metals, sulfur, nitrogen, gum, asphaltene and acid value, and an increasingly higher density and viscosity. The price difference between inferior crude oil and high quality crude oil are becoming larger as the shortage of the resource of petroleum oil. There is more concern for the process which could treat inferior crude oil. It is a challenge for conventional fluid catalytic cracking (FCC) process to treat inferior crude oil to maximize the yield of the light oil.

Generally, there are three types of processing technologies for the heavy oil. The first type is hydrogenation technology which includes hydrotreating and hydrofining process. The second type is decarburization technology which includes solvent deasphalting, delayed coking and heavy oil catalytic cracking process. The third type is aromatics extraction technology. Inferior heavy oil could be converted to low boiling point compound using these technologies whereby the hydrogen to carbon ratio is improved. When the inferior heavy oil is processed by a decarburization technology, the decarburization technology is greatly influenced by the high amount of sulfur, nitrogen, heavy metal, aromatics, gum and asphaltene contained in the inferior heavy oil, so the yield of liquid product is low and the quality of the product is worse. For delayed coking, removal ratio of impurities is high, but coke yield is almost 1.5 times higher than carbon residue of the feedstock, and another problem is how to take use of the solid coke. The hydrogenation technology could remedy defects of decarburization technology, wherein liquid product yield is higher and has good quality, but the investment is relatively large. The armomatics extraction technology's investment is lower, and it can not only achieve good effects in the heavy oil processing, but also obtain aromatics as byproduct which is an important chemical engineering raw material.

CN1448483A discloses a combined process of hydrotreating technology and decarburization technology. Firstly, residual oil is processed in thermal cracking reactor under mild conditions, then the thermal cracking product and slurry of FCC are subjected to solvent deasphalting, and the solvent deasphalting oil is hydrogenated in the presence of hydrogenation catalyst and hydrogen. The advantage of this process is that severity of residual oil hydroteating unit decreases and hydrogenation catalyst's life is prolonged. The yield and quality of liquid product are improved, but deasphalted oil is difficult to be utilized.

CN1844325A discloses a combined process of hydrotreating technology and decarburization technology. Inferior heavy oil is processed with solvent deasphalting and delayed coking, then the solvent deasphalted oil and coker gas oil is hydrotreated as feedstock for heavy oil hydrogenation units. Hydrotreating condition is mild and quality of feedstock is improved, so the hydrotreating unit operating cycle period is prolonged. The combined process can provide good quality feedstock for the downstream FCC unit, but the process flow is complex and the liquid yield is low.

CN1382776A discloses a combined process of residual oil hydrotreating technology and heavy oil catalytic cracking technology. Residual oil, slurry distillate, FCC heavy cycle oil and optional distillate oil are introduced to hydrotreating unit as feedstock, which are subjected to a hydrogenation reaction in the present of hydrotreating catalyst and hydrogen. After gasoline and diesel oils are evaporated from the oils resulting from the reaction, hydrogenated residual and optional vacuum gas oil are introduced to FCC unit, which carry out catalytic cracking reaction. The resultant heavy cycle oil and slurry distillate from FCC unit are introduced to residual hydrotreating unit. Slurry and heavy cycle oil can be converted to high quality fuel oil with this combined process, so the yield of gasoline and diesel increases. The advantage of hydrotreated heavy oil introduced to FCC unit is the higher liquid yield and product quality. The disadvantage of the process consists in a severe hydrotreating condition, a high operating pressure and temperature, a low space velocity, a short operating cycle period, and a high investment, because the heavy oils have high density, viscosity and high amount of heavy metal, gum and asphaltene. Generally, quality of hydrotreated residue which will be provided to FCC is fluctuating from operating initial stage to operating end stage of the hydroteating unit, and the fluctuating feedstock quality will bring unfavorable effects to FCC unit. The composition of the feedstock of hydroteating unit is extremely complex, which contains not only sulfur, nitrogen, and metals, but also alkane, cycloalkane and aromatics. Alkane can be easily cracked to small hydrocarbons and even dry gas under hydrotreating conditions, resulting in an ineffective use of the heavy oil resource. There are 8%~10 wt % unconverted heavy oil when the residue oil is processed in FCC unit, and thus it cause a low utilization efficiency of the heavy oil. Although the unconverted heavy oil can be introduced to hydrotreating unit, the improvement of unconverted heavy oil quality is limited, since the quality of the unconverted heavy oil and residual is greatly different and the heavy oil has a low content of hydrogen.

CN1746265A discloses a catalytic cracking process for inferior feedstock. Light diesel fraction product is cycled back to FCC unit and heavy oil is extracted by solvent. Heavy aromatics obtained from extraction are useful chemical materials. Raffinate oil is cycled back to FCC unit. The heavy oil problem is solved in some extent, but final boiling points of light diesel and heavy diesel need to be not less than 300° C. and 450° C. respectively. The light diesel is cycled back to FCC unit as feedstock and the heavy diesel is introduced into extraction unit. The raffinate of heavy diesel is introduced into FCC unit as feedstock. As a result, although the oil slurry content is decreased to some degree, it is still undesirably high. Moreover, there is no diesel product and the dry gas yield is relatively high.

CN1766059A discloses a method to treat inferior heavy oil or residual oil. Heavy oil or residual oil are introduced to a solvent extraction unit, and the resultant raffinate oil is introduced to fixed bed hydrotreating unit which produce hydrogenation tail oil. The hydrogenation tail oil is introduced to FCC unit which produces slurry and other products. A part of or all slurry and raffinate oil are introduced to suspended bed hyrotreating unit, in which the products are separated to produce light fractions and unconverted oil which is extracted in solvent extraction unit. The process have some advantages in treating heavy oil which combines catalytic cracking technology, extraction technology and hydrotreating technology, however, this process has a complex flow and the liquid yield is low.

Yield of high acid value and high calcium crude oil is increasingly exploited with the development of exploitation technology. Calcium compounds in crude oil are mainly non-porphyrins which are only dissolvable in petroleum fraction and hardly removed from crude oil by conventional desalination method. If acid value of crude oil exceeds 0.5 mgKOH/g, the conventional crude distillation unit almost could not treat this high acid value oil which corrodes the processing equipment. To this end, CN1827744A discloses a method to treat high acid value crude oil. Pretreated high acid value crude oil having a total acid value greater than 0.5 mg KOH/g is preheated and then introduced to FCC unit to contact with the catalyst to carry out catalytic cracking under the FCC reaction conditions, and then the resultant product vapors are separated from the catalyst and fed to a subsequent separation system. The spent catalyst is stripped and regenerated to recycle. This method has a good industry practicability, good deacidification and low operation cost, but both dry gas and coke yield are high.

For long time, ordinary technicians in catalytic filed hold a point that conversion of heavy oil in catalytic cracking is the higher the better. To the contrary, after creative thinking and experiments, the inventors surprisingly find that target products become less and less but dry gas and coke yield increases greatly when the conversion of heavy oil exceeds a certain degree.

In order to effectively utilize inferior heavy oil and meet the increasing market requirements of high quality fuel oil, it is necessary to develop a process to convert inferior heavy oil to a great amount of light and clean fuel oil.

SUMMARY OF THE INVENTION

An object of the present invention is to provide a catalytic conversion process, in particular, for converting inferior heavy oil into light and clean fuel oil in a great amount.

The process of the present invention comprises the steps as follow:

(1) a preheated inferior feedstock is introduced into a first reactor zone in a catalytic conversion reactor and is subjected to catalytically cracking reactions by contacting with a catalytic conversion catalyst; the product vapors and used catalyst, which are optionally mixed with light feedstocks and/or quench mediums, are introduced into a second reactor zone in the catalytic conversion reactor for further cracking, hydrogen transferring and isomerizing reactions; the resultant reaction products are separated from the spent catalyst by gas-solid separation, and then the reaction products are introduced into a separation system to obtain dry gas, LPG, gasoline, diesel and fluid catalytic cracking gas oil (FGO); optionally, the spent catalyst is stripped by steam, and then fed into a regenerator to be regenerated by burning off the coke, and then the heated regenerated catalyst is recycled to the reactor; wherein the reaction conditions in said first and second reactor zones reaction are sufficient to achieve a yield of FGO between 12% and 60% by weight of the feedstock;

(2) said FGO is introduced into a hydrotreating unit and/or an aromatics extraction unit to obtain hydrotreated FGO and/or a raffinate of FGO;

(3) said hydrotreated FGO and/or the raffinate of FGO are recycled to the first reactor zone in the catalytic conversion reactor and/or other FCC units for further reactions to obtain the target product high quality fuel oil.

In an embodiment of the present invention, a preheated inferior feedstock is introduced into the first reactor zone by the prelift medium steam and contacts with the hot regenerated catalytic conversion catalyst. Catalytic cracking reaction temperature is preferably from 510° C. to 650° C., and even more preferably from 520° C. to 600° C., weight hourly space velocity (WHSV) is preferably from 10 $h^{-1}$ to 200 $h^{-1}$, and even more preferably from 15 $h^{-1}$ to 150 $h^{-1}$, weight ratio of catalyst to feedstock (or raw oil) (hereinafter referred to as C/O ratio) is preferably from 3:1 to 15:1, and even more preferably from 4:1 to 12:1, weight ratio of steam to feedstock (or raw oil) (hereinafter referred to as S/O ratio) is preferably from 0.03:1 to 0.3:1, and even more preferably from 0.05:1 to 0.2:1, reaction pressure is from 130 kPa to 450 kPa. Under said reaction conditions. The feedstock is subjected to cracking reactions of macromolecule, and at least one kind of impurities such as metal, sulfur, nitrogen and naphthenic acid can be removed from the inferior feedstock.

The produced vapors and used catalyst, which are optionally mixed with light feedstocks and/or quench mediums, are introduced into a second reactor zone in the catalytic conversion reactor for further cracking, hydrogen transferring and isomerizing reactions at a reaction temperature from 420° C. to 550° C., and even more preferably from 460° C. to 530° C., and a WHSV from 5 $h^{-1}$ to 150 $h^{-1}$, and even more preferably from 15 $h^{-1}$ to 80 $h^{-1}$. The product vapors are introduced into separation system to obtain dry gas, liquified petroleum gas (LPG) including propylene, propane, and C4 hydrocarbon, gasoline, diesel and FGO. Optional, the propane, C4 hydrocarbon, and diesel can be recycled back to the second reactor zone as light feedstock.

Said FGO alone or mixed with diesel and/or other heavy oil are introduced into hydrotreating unit. Said hydrotreated FGO is stripped to remove light hydrocarbon molecular, and the stripped hydrotreated FGO is returned to first reactor zone in the present catalytic conversion reactor and/or other FCC units for further reaction to obtain the target product high quality fuel oil and propylene.

Alternatively or additionally, said FGO is introduced into aromatics extraction unit to obtain raffinate of FGO using prior aromatics extraction process. The extracted oil is rich in aromatics which is chemical material. Said raffinate of FGO returns to first reactor zone in the present catalytic conversion reactor and/or other FCC units for further reaction to obtain the target product high quality fuel oil and propylene.

Obtained hydrotreated FGO and/or raffinate of FGO can return to the first reactor zone in the present catalytic conversion reactor and/or other FCC units for further reaction to obtain the target product high quality fuel oil and propylene.

Said other FCC units are conventional catalytic cracking units or the improved equipments thereof. More detailed description of this reactor is referred to Chinese patent application CN1232069A and CN1232070A.

Said inferior feedstock is selected from heavy petroleum hydrocarbons and/or other mineral oils, wherein the petroleum hydrocarbon is one selected from the group consisting of vacuum residue (VR), inferior atmospheric residue (AR), inferior hydrotreated residue, coker gas oil (CGO), deasphalted oil (DAO), high acid value content crude oil and high metal content crude oil or mixtures thereof, and the other mineral oil is one selected from the group consisting of coal liquefied oil, tar sand oil and shale oil or mixtures thereof.

Said inferior feedstock meets at least one of the following criteria:

Density is preferably from 900 kg/$m^3$ to 1000 kg/$m^3$, and even more preferably from 930 kg/$m^3$ to 960 kg/$m^3$, carbon residue is preferably from 4 w % to 15 w %, and even more preferably from 6 w % to 12 w %, metal contents from 15 ppm to 600 ppm, and even more preferably from 15 ppm to 100 ppm, acid value from 0.5 mgKOH/g to 20 mgKOH/g, and even more preferably from 0.5 mgKOH/g to 10 mgKOH/g.

Said light feedstock is one selected from the group consisting of LPG, gasoline and diesel or mixtures thereof. Said LPG is one selected from LPG obtained from this process and/or other process. Said gasoline is one selected from gasoline obtained from this process and/or other process. Said diesel is one selected from diesel obtained from this process and/or other process.

The FGO is one obtained from the present system or produced from other system such as conventional FCC. The cutting temperature of FGO is not less than 250° C., and the hydrogen content of FGO is not less than 10.5% by weight. In the more preferred embodiment, the cutting temperature of FGO is not less than 300° C., more preferably 330° C., and the hydrogen content of FGO is not less than 10.8% by weight.

Said hydrotreated FGO is one obtained from hydrogenation of FGO produced from this system and/or other system such as conventional FCC unit. Hydrotreated FGO can be introduced into conventional catalytic cracking unit as feedstock.

Said raffinate of FGO is one selected from aromatics extraction raffinate of FGO obtained from this system and/or other system such as conventional FCC unit. Raffinate of FGO can be introduced into conventional catalytic cracking unit as feedstock.

Said quench medium is one selected from quench agent, cooled regenerated catalyst, semi-regenerated catalyst, spent catalyst and fresh catalyst or mixtures thereof. The quench agent is one selected from the group consisting of LPG, naphtha, stabilized gasoline, diesel, heavy diesel and water or mixtures thereof. The cooled regenerated catalyst and semi-regenerated catalyst are obtained by cooling catalyst through catalyst cooler after the spent catalyst being regenerated by two-stage and one-stage regeneration respectively. The regenerated catalyst refers to catalyst that has a residual carbon content of below 0.1% by weight, more preferably below 0.05% by weight. The semi-regenerated catalyst refers to catalyst that has a residual carbon content of from 0.1% to 0.9% by weight, more preferably from 0.15% to 0.7% by weight. The spent catalyst refers to catalyst that has a residual carbon content of above 0.9% by weight, more preferably from 0.9% to 1.2% by weight.

The boiling range of gasoline and diesel can be changed according to the requirements of refinery. Gasoline or diesel include but are not only limited by the total distillation range fraction.

In the more preferred embodiment, said catalyst comprises zeolite, inorganic oxide and optional clay, which account for the following percent of the total weight of the catalyst respectively: zeolite 1~50% by weight, inorganic oxide 5~99% by weight, and clay 0~70% by weight. Said zeolite, as active components, is selected from large pore size zeolite and optional medium pore zeolite. Said medium pore size zeolite accounts for from 0% to 100%, and even more preferably from 0% to 50%, and even more preferably from 0% to 20% of the total weight of zeolite. Said large pore size zeolite accounts for from 0% to 100%, and even more preferably from 20% to 80% of the total weight of zeolite. The medium pore size zeolite is selected from ZSM series zeolites and/or ZRP zeolites, or ZSM and ZRP zeolites modified with non-metal elements such as phosphor and/or transition metal elements such as iron, cobalt and nickel. See U.S. Pat. No. 5,232,675 for more detailed description of ZRP zeolites. The ZSM series zeolite is one selected from the group consisting of ZSM-5, ZSM-11, ZSM-12, ZSM-23, ZSM-35, ZSM-38, ZSM-48, and other zeolites with similar structure, or mixture thereof. Please refer to U.S. Pat. No. 3,702,886 for more detailed description of ZSM-5 zeolties. The large pore size zeolite is one selected from Y series zeolites, which include: rare-earth Y (REY), rare-earth HY (REHY), ultrastable Y and high silica Y obtained by different processes or mixtures thereof.

The inorganic oxide as a binder is selected from silica (SiO2) and/or alumina (Al2O3).

The clay as a matrix (i.e. supporter) is selected from kaolin and/or halloysite.

Said catalyst can be selected from dump equilibrium catalyst which is used in conventional catalytic cracking unit.

Said catalyst in each reactor may be of identical or different types. Said different type catalysts can be different in particle size and/or apparent packing density. Said catalysts with different particle size and/or apparent packing density can be selected from zeolites of different types. Said catalysts with different particle size and/or apparent packing density can be charged into different reactor zones. For example, big particle size catalyst which contains ultrastable Y zeolite is charged into first reactor zone to enhance cracking reactions, and small particle size catalyst which contains rare-earth Y zeolite is charged into second reactor zone to enhance hydrogen transfer reactions. The different particle size catalysts are stripped and regenerated in same stripping equipment and regenerator, and then the regenerated catalysts are separated to obtain small and big particle size catalyst. The cooled small particle size catalyst is charged into second reactor. By small particle size catalyst is meant to the catalyst having a particle size catalysts below 30 microns(μm) −40 microns, and by big particle size catalyst is meant to the catalyst having a particle size catalysts above 30 microns-40 microns. By low apparent packing density catalyst is meant to the catalyst having a apparent packing density below 0.6 $g/cm^3$-0.7 $g/cm^3$, and by high apparent packing density catalyst is meant to the catalyst having a apparent packing density above 0.6 $g/cm^3$-0.7 $g/cm^3$.

In the more preferred embodiment, said reactor is one selected from a riser, an iso-linear speed fluidized bed, an iso-diameter fluidized bed, a riser with varied diameters, a fluidized bed, a composite reactor consisting of an iso-diameter riser and fluidized bed. In the more preferred embodiment, said reactor is a composite reactor consisting of an iso-diameter riser or a riser with varied diameters and fluidized bed. The fluidized bed reactor is selected from a cascade and/or parallel combination of one or more selected from a riser, an iso-linear speed fluidized bed, an iso-diameter fluidized bed, a descending transfer line and an ascending transfer line, wherein said riser is a conventional iso-diameter riser or various risers with varied diameters. Said fluidized bed gas velocity is preferably from 0.1 m/s to 2 m/s, and said riser gas velocity is preferably from 2 m/s to 30 m/s (not counting catalyst).

One best embodiment of the present invention is conducted in a riser reactor with varied diameters. More detailed description of this reactor is referred to Chinese Patent Application CN1237477A.

In the hydrotreating unit, feedstock is hydrotreated in the presence of hydrogen gas by contacting with a hydrotreating catalyst at the following conditions: hydrogen partial pressure 3.0 MPa~20.0 MPa, reaction temperature 300 C~450° C., hydrogen/oil ratio 300~2000 by volume, and volume hourly space velocity 0.1 $h^{-1}$~3.0 $h^{-1}$.

Said extraction unit can be one selected from present aromatics exaction units. Said extraction solvent is one selected from dimethyl sulfoxide, furfural, dimethylformamide, monoethanolamine, ethylene glycol and 1,2-propanediol or mixture thereof. The extraction solvent can be recycled. The extraction temperature is preferably from 40° C. to 120° C., and the solvent/FGO ratio is preferably from 0.5:1 to 5.0:1 by volume.

The technical solutions of the present invention integrate fluid catalytic cracking process with hydrotreating process and/or the solvent extraction process and/or conventional catalytic cracking process to obtain a maximum of high quality fuel oil and an enhanced yield of propylene, particularly high octane gasoline from inferior feedstock. The present invention has several important advantages over the prior art in that:

1. Since inferior FGO feedstock is treated by catalytic cracking unit firstly, and then which are treated by the hydrotreating unit and/or the extraction unit, and therefore the quality of the feedstock for hydrotreating unit and/or aromatics extraction unit are improved considerably.

2. The run period of hydrotreating unit and/or extraction unit increases considerably since the feedstock quality of hydrotreating unit and/or extraction unit is improved.

3. The FGO obtained from catalytic cracking unit is rich in cycloalkane, but long chain alkane content is low. The feedstock of hydrotreating unit which is provided by FCC unit is improved, so light hydrocarbon product yield decreases significantly, particularly for dry gas. The obtained FGO can be extracted by an extraction unit, and the extracted oil is rich in double ring aromatics which are good chemical material, and the FGO raffinate oil (i.e. non-aromatic hydrocarbons) is rich in chain alkane and cycloalkane which can be used as one of the FCC feedstock.

4. The quality of feedstock provided by hydrotreating unit and/or extraction unit remains stable from operating initial stage to operating end stage. The stable quality of feedstock is favorable for catalytic cracking unit operation.

5. The high quality fuel oil yield increases obviously, and the slurry yield decreases significantly, and therefore, the process of the present invention can utilize petroleum oil resources more efficiently.

DETAILED DESCRIPTION OF THE EMBODIMENTS

The accompanying drawing, which is hereby incorporated in this specification, illustrates several embodiments of the invention and together with the description serves to explain but not limit the scope of the present invention. Thus, it will be apparent to one skilled in the art that certain modifications may be made to the invention as described without departing from the scope of the claims set out below.

Figure 1:
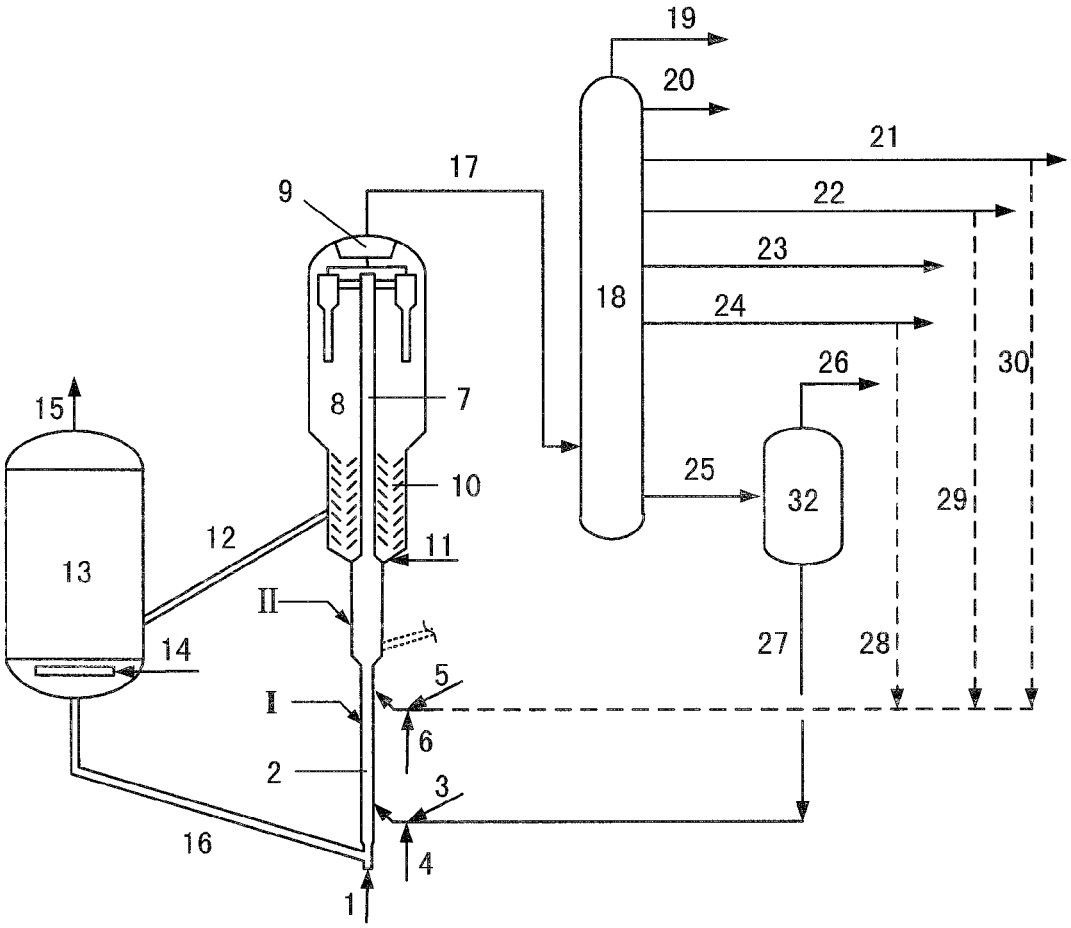
FIG. 1 is a schematic representation for the first embodiment of the process of the present invention.

According to the first specific embodiment of the present invention, the process of the present invention can be carried out according to the scheme shown in FIG. 1 wherein the hydrotreated FGO is recycled back to the first reaction zone in the catalytic conversion reactor according to the present process A prelift medium is introduced via a line 1 into the lower part of a riser reactor 2. The regenerated catalyst from a line 16 is lifted by the prelift medium and moves upward. A inferior feedstock from a line 3, along with the atomized steam from a line 4, is injected into the lower part of the reaction zone I of the riser reactor 2, and mixed with the existing stream in the riser reactor. Said inferior feedstock cracks on the hot catalyst, and it moves upward. A light feedstock from a line 5, along with the atomized steam from a line 6, is injected into the lower part of the reaction zone II of the riser reactor 2, and mixed with the existing stream in the riser reactor. The feedstock cracks on the catalyst having a little deposited coke thereon, and it moves upward. The resulting reaction product vapors and the deactivated spent catalyst, through a line 7, enter a cyclone separator of a disengager 8, wherein the spent catalyst and the reaction product vapors are separated. The reaction product vapors exit the cyclone and flow into a plenum chamber 9. Fine catalyst particles go back to the disengager via a dipleg. The spent catalyst in the disengager flows into a stripping section 10 and contacts with a steam from a line 11. The reaction product vapors stripped out of the spent catalyst enter the plenum chamber 9, via the cyclone. The stripped spent catalyst flows into a regenerator 13 via a chute 12. A main air enters the regenerator via a conduit 14 to burn off the coke deposited on the spent catalyst and regenerate the deactivated spent catalyst. Flue gas flows into turbine via a line 15. The regenerated catalyst is recycled into the riser reactor via the chute 16.

Reaction product vapors in the plenum chamber 9 are transported via a transfer line 17 and introduced into a sequent separation system 18. The separated propylene product is removed via a line 20; the separated propane product is removed via a line 21; the C4 hydrocarbons product is removed via a line 22; optional, the separated propane and C4 hydrocarbons, as a part of the light feedstock, can be cycled back to the reaction zone II of the riser reactor 2 via a line 30 and 29 respectively; the separated dry gas product is removed via a line 19; the separated gasoline product is removed via a line 23; the separated diesel product is removed via a line 24 or is recycled back to the reaction zone II of the riser reactor 2 as a part of light feedstock via a line 28; and the separated FGO product is introduced via a line 25 into a hydrotreating unit 32, wherein the separated light component is removed via a line 26 and the hydrotreated FGO is recycled back to the reaction zone I of the riser reactor 2 via line 27 for further producing high octane gasoline, propylene, and diesel.

Figure 2:
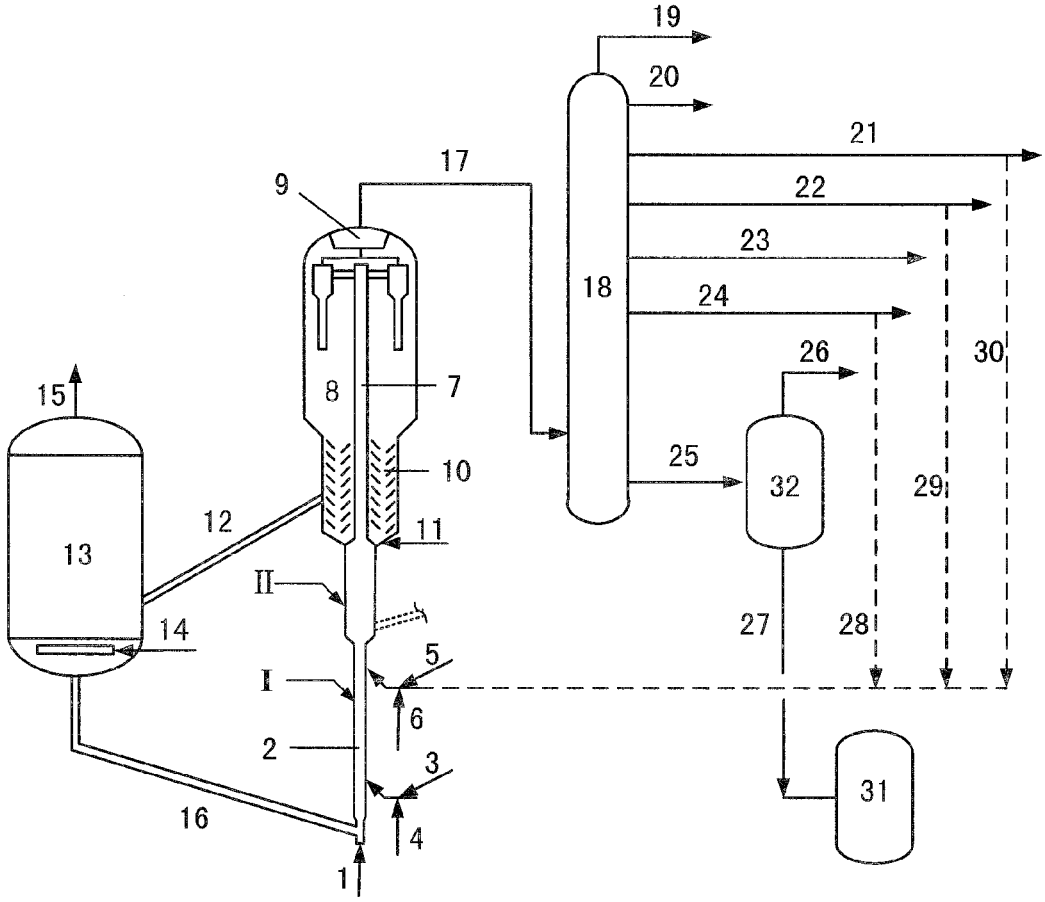
FIG. 2 is a schematic representation for the second embodiment of the process of the present invention.

According to the second specific embodiment of the present invention, the process of the present invention can be carried out according to the scheme shown in FIG. 2. In the embodiment hydrotreated FGO product is cycled back to another catalytic cracking unit. The technological flow of the embodiment is similar to the first specific embodiment except that the hydroteating FGO product is introduced to another catalytic cracking unit 31 via a line 27, wherein the FGO is converted to high octane gasoline, propylene and diesel (not shown).

Figure 3:
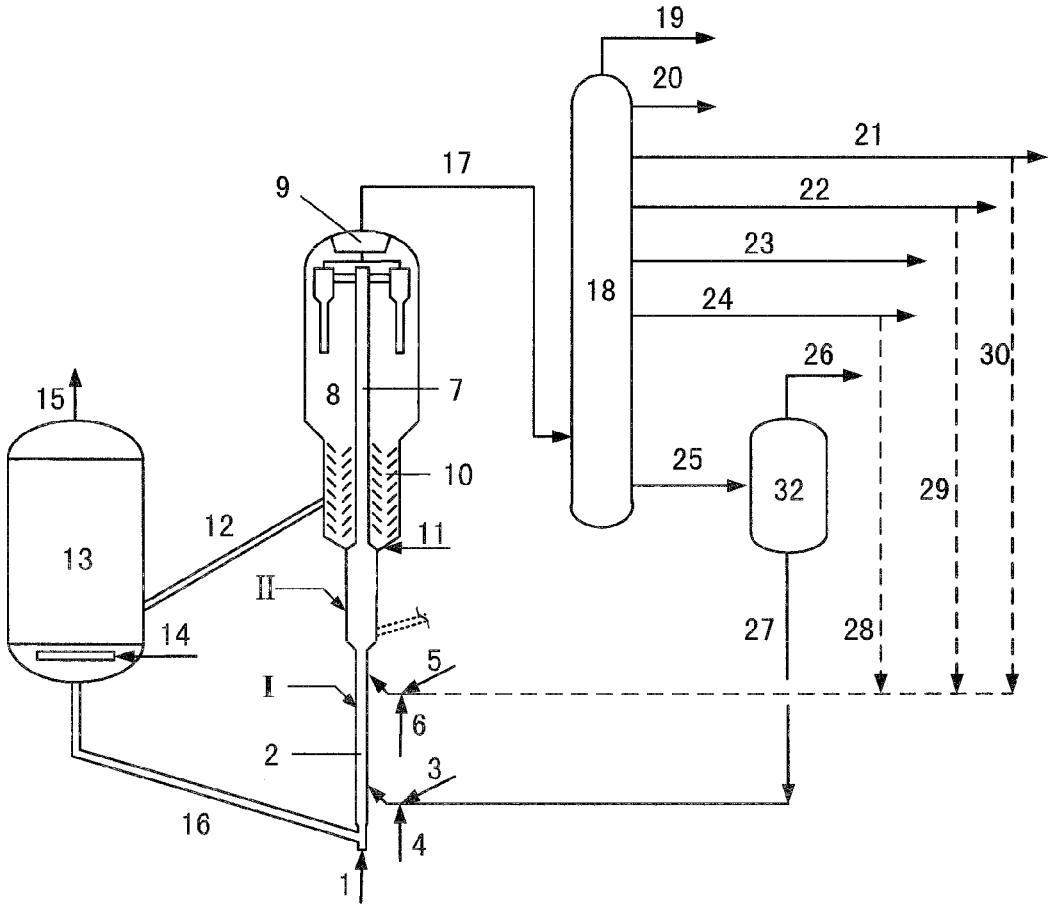
FIG. 3 is a schematic representation for the third embodiment of the process of the present invention.

According to the third specific embodiment of the present invention, the process of the present invention can be carried out according to the scheme shown in FIG. 3 wherein the raffinate of FGO is recycled back to the first reaction zone in the catalytic conversion reactor according to the present process.

A prelift medium is introduced via a line 1 into the lower part of a riser reactor 2. The regenerated catalyst from a line 16 is lifted by the prelift medium and moves upward. A inferior feedstock from a line 3, along with the atomized steam from a line 4, is injected into the lower part of the reaction zone I of the riser reactor 2, and mixed with the existing stream in the riser reactor. Said inferior feedstock cracks on the hot catalyst, and it moves upward. A light feedstock from a line 5, along with the atomized steam from a line 6, is injected into the lower part of the reaction zone II of the riser reactor 2, and mixed with the existing stream in the riser reactor. The feedstock cracks on the catalyst having a little deposited coke thereon, and it moves upward. The resulting reaction product vapors and the deactivated spent catalyst, through a line 7, enter a cyclone separator of a disengager 8, wherein the spent catalyst and the reaction product vapors are separated. The reaction product vapors exit the cyclone and flow into a plenum chamber 9. Fine catalyst particles go back to the disengager via a dipleg. The spent catalyst in the disengager flows into a stripping section 10 and contacts with a steam from a line 11. The reaction product vapors stripped out of the spent catalyst enter the plenum chamber 9, via the cyclone. The stripped spent catalyst flows into a regenerator 13 via a chute 12. A main air enters the regenerator via a conduit 14 to burn off the coke deposited on the spent catalyst and regenerate the deactivated spent catalyst. Flue gas flows into turbine via a line 15. The regenerated catalyst is recycled into the riser reactor via the chute 16.

Reaction product vapors in the plenum chamber 9 are transported via a transfer line 17 and introduced into a sequent separation system 18. The separated propylene product is removed via a line 20; the separated propane product is removed via a line 21; the C4 hydrocarbons product is removed via a line 22; optionally, the separated propane and C4 hydrocarbons, as a part of the light feedstock, can be cycled back to the reaction zone II of the riser reactor 2 via a line 30 and 29 respectively; the separated dry gas product is removed via a line 19; the separated gasoline product is removed via a line 23; the separated diesel product is removed via a line 24 or is recycled back to the reaction zone II of the riser reactor 2 as a part of light feedstock via a line 28; and the separated FGO product is introduced via a line 25 into a extraction unit 32, wherein the extracted oil is removed via a line 26 and the raffinate of FGO (that is said non-aromatic hydrocarbons) is recycled back to the reaction zone I of the riser reactor 2 via line 27 for further producing high octane gasoline, propylene, and diesel.

Figure 4:
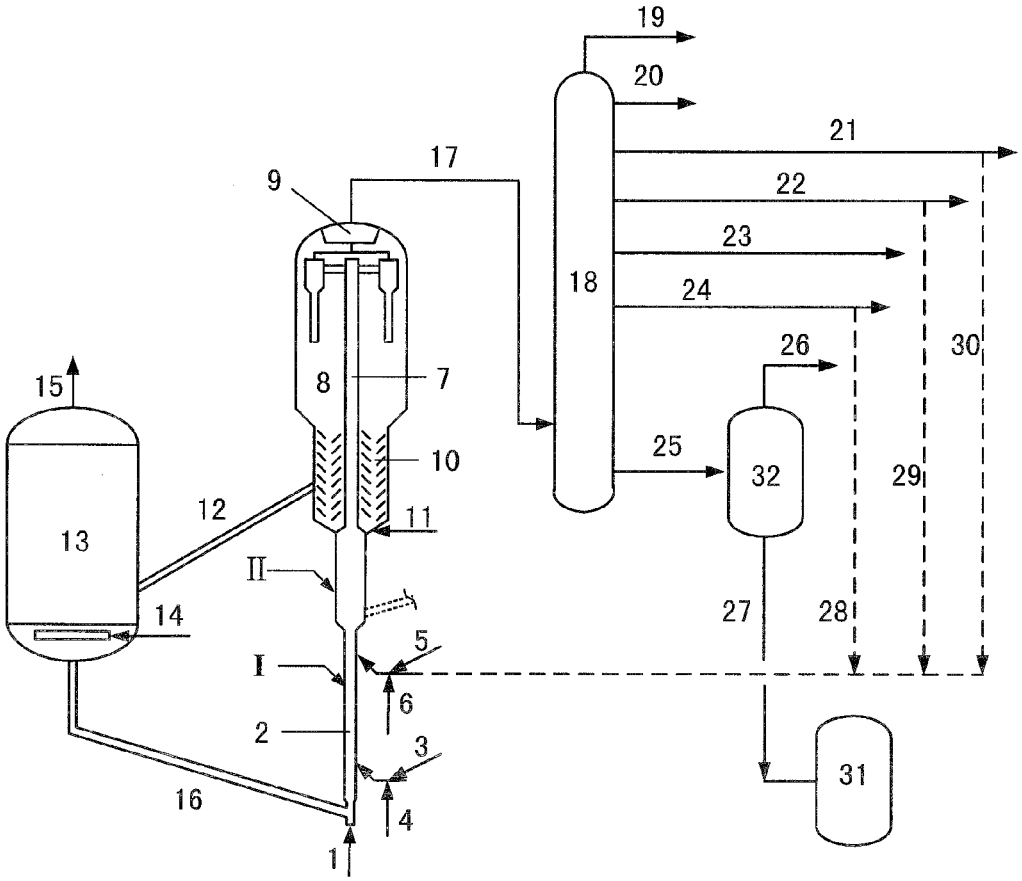
FIG. 4 is a schematic representation for the fourth embodiment of the process of the present invention.

According to the fourth specific embodiment of the present invention, the process of the present invention can be carried out according to the scheme shown in FIG. 4. In the embodiment extraction FGO product is cycled back to another catalytic cracking unit. The technological flow of the embodiment is similar to the third specific embodiment except that the raffinate of FGO is introduced to another catalytic cracking unit 31 via a line 27, wherein the FGO is converted to high octane gasoline, propylene and diesel (not shown).

The following examples are used to demonstrate the effect of the present invention and are not meant to limit the scope of the invention to the detail examples shown herein. The properties of the feedstock are listed in table 1.

Catalyst GZ-1 used in the examples was prepared as follows:

1) 20 g $NH_4Cl$ was dissolved in 1000 g water, and 100 g (dry basis) crystallized product ZRP-1 zeolite (an MFI-structured zeolite produced in Qilu Petrochemical Co. with a $SiO2/Al_2O_3$ molar ratio of 30, a content of rare earth $RE_2O_3$=2.0% by weight) was added to this solution, after exchanging at 90° C. for 0.5 h, filtering to yield a filter cake. 4.0 g of $H_3PO_4$ (with a concentration of 85 wt %) and 4.5 g of $Fe(NO_3)_3$ were dissolved in 90 g water to obtain a solution. The filter cake was impregnated with the obtained solution and dried. The resultant solid was calcined at 550° C. for 2 hours to yield an MFI-structured medium pore sized zeolite containing phosphor and iron. The anhydrous chemical formula of the catalyst was $$0.1Na_2O.5.1Al_2O_3.2.4P_2O_5.1.5Fe_2O_3.3.8RE_2O_3.88.1SiO_2.$$

2) 75.4 kg halloysite clay (an industrial product of Suzhou Porcelain Clay Co. with a solid content of 71.6% by weight) was slurried with 250 kg deionized water, whereto 54.8 kg pseudo-boehmite (an industrial product of Shandong Alumina Plant with a solid content of 63% by weight) was added. The PH value was adjusted to 2~4 with hydrochloric acid. The slurry was uniformly stirred and laid aside for aging at 60~70° C. for 1 hour. The temperature was decreased to below 60° C. while maintaining the PH value at 2~4, and then 41.5 kg alumina sol (a product of Qilu Petrochemical Co. with an $Al_2O_3$ content of 21.7% by weight) was added. After stirring for 40 min, a mixed slurry was obtained.

3) 2 kg (dry basis, prepared in step 1) MFI-structured medium pore sized zeolite containing phosphor and iron and 22.5 kg (dry basis) DASY zeolite (an ultrastable zeolite-Y product of Qilu Petrochemical Co. with a unit cell size of 2.445~2.448 nm) were added into the mixed slurry (prepared in step 2) and uniformly stirred to yield a slurry. The obtained slurry was shaped by spray drying, and the product was washed off the free Na+ with ammonium dihydrogen phosphate solution (phosphor content 1% by weight). After drying, a sample of the catalytic conversion catalyst was obtained. The composition of the catalyst was 2% by weight of MFI-structured medium pore sized zeolite containing phosphor and iron, 18% by weight of DASY zeolite, 32% by weight of pseudo-boehmite, 7% by weight of alumina sol, and balanced kaolin.

Hydroteating catalyst used in the examples was prepared as follows:

An 200 mL aqueous solution was prepare from ammonium metatungate ($(NH_4)_2W_4O_{13}.18H_2O$, "chemical pure" grad) and nickelous nitrate ($Ni(NO_3)_2.18H_2O$, "chemical pure" grad) by water dissolution. 50 g alumina support was added to the aqueous solution and impregnated for 3 hours under room temperature. During impregnation, the impregnating solution was treated by ultrasonic for 30 minutes, and then which was cooled, filtered, and then which was dried by microwave oven for 15 minutes. The composition of the catalyst was 30.0% by weight of $WO_3$, 3.1% by weight of NiO, and balanced aluminum oxide.

Conventional catalytic conversion catalysts MLC-500 and CGP-1 were used in the examples, which properties were listed in Table 2.

Example 1

In the experiment of the present example, Vacuum residue oil A was directly used as the feedstock of catalytic cracking and the experiment was conducted in a pilot riser reactor plant. Inferior feedstock A was injected into the lower part of the reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I, the recycled propane, C4 hydrocarbons and diesel are mixed and subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG (include propylene, propane and C4 hydrocarbons), gasoline, diesel and FGO (the cutting temperature is above 330° C.) were withdrawn. The resultant FGO is in an amount of 24.48% by weight of the feedstock. Then the FGO was hydrotreated, wherein the reaction temperature was 350° C., the hydrogen partial pressure was 18.0 MPa, the hydrogen/oil ratio was 1500 by volume, and the volume hourly space velocity was 1.5 $h^{-1}$. The hydrotreated FGO was introduced to another above mentioned type pilot riser reactor plant as feedstock, wherein the catalytic cracking catalyst was MLC-500. In reactor zone I, the reaction temperature was 600° C., the WHSV was 100 $h^{-1}$, and the C/O was 6. In reactor zone II, the reaction temperature was 500° C., the WHSV was 20 $h^{-1}$, and the C/O was 6. The product vapors were separated to obtain dry gas, LPG, gasoline, diesel, and FGO which was returned to the hydrotreating unit. Operating conditions and product slate were listed in table 3.

It can be seen from Table 3 that the total light hydrocarbons (LPG, gasoline and diesel) yield attains as high as 88.39% by weight; the gasoline yield attains as high as 51.75% by weight; the propylene yield attains as high as 5.05% by weigh; the dry gas yield is only 2.62% by weight; the slurry yield is only 1.10% by weight.

Comparative Example 1

Vacuum residue feedstock A was directly used as the feedstock of catalytic cracking and the experiment was conducted in a pilot riser reactor plant, wherein the reaction temperature was 500° C., the reaction time was 2.5 seconds, the C/O was 6, and the weight ratio of steam/the feedstock was 0.05. Reaction product vapors and the spent catalyst were separated in the disengager, and then the products were separated, wherein dry gas, LPG, gasoline, diesel and slurry were withdrawn. Operating conditions and product slate were listed in table 3.

It can be seen from Table 3 that the total light hydrocarbons yield is only 77.44% by weight; the gasoline yield is only 43.76% by weight; the propylene yield is only 4.21% by weigh; the dry gas yield attains as high as 3.49% by weight; the slurry yield attains as high as 9.18% by weight. Compared to example 1, light hydrocarbons yield decreases significantly, so the petroleum resources are underutilized.

Example 2

The experiment of the present example was carried out according to the scheme shown in FIG. 2. Feedstock C was directly used as the feedstock of catalytic cracking and the experiment was conducted in a pilot riser reactor plant. Inferior feedstock C was injected into the lower part of the reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I and quench medium (cooled regenerated catalyst) are mixed and subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 38.57% by weight of the feedstock. Then the FGO was hydrotreated, wherein the reaction temperature was 350° C., the hydrogen partial pressure was 18.0 MPa, the hydrogen/oil ratio was 1500 by volume, and the volume hourly space velocity was 1.5 $h^{-1}$. The hydrotreated FGO was introduced to another conventional pilot riser reactor plant as feedstock, wherein the catalytic conversion catalyst was CGP-1. In reactor zone I, the reaction temperature was 600° C., the WHSV was 100 $h^{-1}$, and the C/O was 6, steam/feedstock ratio was 0.10. In reactor zone II, the reaction temperature was 500° C., the WHSV was 20 $h^{-1}$, and the C/O was 6. The product vapors were separated to obtain dry gas, LPG, gasoline diesel and slurry which was returned to hydrotreating unit. Operating conditions and product slate were listed in table 4.

It can be seen from Table 4 that the total light hydrocarbons yield attains as high as 87.49% by weight; the gasoline yield attains as high as 41.35% by weight; the propylene yield attains as high as 8.04% by weigh; the dry gas yield is only 2.68% by weight; the slurry yield is only 1.30% by weight.

Comparative Example 2

Feedstock C was directly used as the feedstock of catalytic cracking and the experiment was conducted in a pilot riser reactor plant, wherein the catalyst is CGP-1, the reaction temperature was 500° C., the reaction time was 2.5 seconds, the C/O was 6, and the weight ratio of steam/the feedstock was 0.10. Reaction product vapors and the spent catalyst were separated in the disengager, and then the products were separated, wherein dry gas, LPG, gasoline, diesel and slurry were withdrawn. Operating conditions and product slate were listed in table 4.

It can be seen from Table 4 that the total light hydrocarbons yield is only 77.29% by weight; the gasoline yield is only 33.04% by weight; the propylene yield is only 7.06% by weigh; the dry gas yield attains as high as 3.63% by weight; the slurry yield attains as high as 9.77% by weight. Compared to example 2, light hydrocarbons yield decreases significantly, so the petroleum resources are underutilized.

Example 3

The experiment of the present example was carried out according to the scheme shown in FIG. 2. High acid value feedstock E was directly used as the feedstock of catalytic cracking and the experiment was conducted in a pilot riser reactor plant. Inferior feedstock E was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I are carried out cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 18.03% by weight of the feedstock. Then the FGO was hydrotreated, wherein the reaction temperature was 350° C., the hydrogen partial pressure was 18.0 MPa, the hydrogen/oil ratio was 1500 by volume, and the volume hourly space velocity was 1.5 $h^{-1}$. The hydrotreated FGO was introduced to another conventional pilot riser reactor plant as feedstock, wherein the catalytic conversion catalyst was CGP-1. In reactor zone I, the reaction temperature was 600° C., the WHSV was 100 $h^{-1}$, steam/feedstock ratio was 0.10, and the C/O was 6. In reactor zone II, the reaction temperature was 500° C., the WHSV was 20 $h^{-1}$, and the C/O was 6. The product vapors were separated to obtain dry gas, LPG, gasoline diesel and FGO which was returned to hydrotreating unit. Operating conditions and product slate were listed in table 5.

It can be seen from Table 5 that the total light hydrocarbons yield attains as high as 87.51% by weight; the gasoline yield attains as high as 40.17% by weight; the propylene yield attains as high as 7.57% by weigh; the dry gas yield is only 3.21% by weight.

Comparative Example 3

High acid value feedstock E was directly used as the feedstock of catalytic cracking and the experiment was conducted in a pilot riser reactor plant, wherein the catalyst is CGP-1, the reaction temperature was 500° C., the reaction time was 2.5 seconds, the C/O was 6, and the weight ratio of steam/the feedstock was 0.10. Reaction product vapors and the spent catalyst were separated in the disengager, and then the products were separated, wherein dry gas, LPG, gasoline, diesel and slurry were withdrawn. Operating conditions and product slate were listed in table 5.

It can be seen from Table 5 that the total light hydrocarbons yield is only 77.29% by weight; the gasoline yield is only 35.43% by weight; the propylene yield is only 6.52% by weigh; the dry gas yield attains as high as 5.51% by weight; the slurry yield attains as high as 6.22% by weight. Compared to example 3, light hydrocarbons yield decreases significantly, so the petroleum resources are underutilized.

Example 4 and Example 5

The experiment of the present example was carried out according to the scheme shown in FIG. 2. Atmospheric residue B and high acid value oil D were directly used as the feedstock of catalytic cracking and the experiment was conducted in a pilot riser reactor plant respectively. Inferior feedstock was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I were subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 41.90% and 34.13 by weight of the feedstock respectively. Then the FGO was hydrotreated, wherein the reaction temperature was 350° C., the hydrogen partial pressure was 18.0 MPa, the hydrogen/oil ratio was 2000 by volume, and the volume hourly space velocity was 1.5 $h^{-1}$. The hydrotreated FGO was introduced to another conventional pilot riser reactor plant as feedstock, wherein the catalytic conversion catalyst was MLC-500. In reactor zone I, the reaction temperature was 600° C., the WHSV was 100 $h^{-1}$, steam/feedstock ratio was 0.05, and the C/O was 6. In reactor zone II, the reaction temperature was 500° C., the WHSV was 20 $h^{-1}$, and the C/O was 6. The product vapors were separated to obtain dry gas, LPG, gasoline diesel and FGO which was returned to hydrotreating unit. Operating conditions and product slate were listed in table 6.

It can be seen from Table 6 that both the total light hydrocarbons yield attain as high as 86.02% and 85.44% by weight respectively; both the gasoline yield attain as high as 41.63% and 45.76% by weight respectively; both the propylene yield attain as high as 5.05% and 4.21% by weight respectively; both the dry gas yield are only 2.89% and 3.03% by weight respectively; both the slurry yield are only 2.30% and 2.18% by weight respectively.

Example 6

The experiment of the present example was carried out according to the scheme shown in FIG. 3. Vacuum residue feedstock A was directly used as the feedstock of catalytic cracking and the experiment was conducted in a pilot riser reactor plant. Inferior feedstock E was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I, cycled back propane, C4 hydrocarbons and diesel are mixed and subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 24.48% by weight of the feedstock. Then the FGO was extracted with furfural, wherein the extraction temperature was 75, the Solvent/FGO ratio was 2.0 (v/v), and then raffinate of FGO (that is said non-aromatic hydrocarbons) and extracted oil were separated. The raffinate of FGO was introduced to the above mentioned pilot riser reactor plant as feedstock. Operating conditions and product slate were listed in table 7.

It can be seen from Table 7 that the total light hydrocarbons yield attains as high as 82.01% by weight; the gasoline yield attains as high as 47.69% by weight; the propylene yield attains as high as 4.86% by weigh; the dry gas yield is only 2.48% by weight; the slurry yield is only 1.04% by weight; the extracted oil (rich in aromatics which is good chemical resource) yield is 7.06% by weight.

Comparative Example 4

Vacuum residue feedstock A was directly used as the feedstock of catalytic cracking and the experiment was conducted in a pilot riser reactor plant, wherein the reaction temperature was 500° C., the reaction time was 2.5 seconds, the C/O was 6, and the weight ratio of steam/the feedstock was 0.05. Reaction product vapors and the spent catalyst were separated in the disengager, and then the products were separated, wherein dry gas, LPG, gasoline, diesel and slurry were withdrawn. Operating conditions and product slate were listed in table 7.

It can be seen from Table 7 that the total light hydrocarbons yield is only 77.44% by weight; the gasoline yield is only 43.76% by weight; the propylene yield is only 4.21% by weigh; the dry gas yield attains as high as 3.49% by weight; the slurry yield attains as high as 9.18% by weight. Compared to example 6, light hydrocarbons yield decreases significantly, so the petroleum resources are underutilized.

Example 7

The experiment of the present example was carried out according to the scheme shown in FIG. 4. Inferior hydrogenated residue feedstock C was directly used as the feedstock of catalytic cracking and the experiment was conducted in a pilot riser reactor plant. Inferior feedstock C was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I and quench medium (cooled regenerated catalyst) are mixed and subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 38.57% by weight of the feedstock. Then the FGO was extracted with furfural, wherein the extraction temperature was 75, the Solvent/FGO ratio was 2.0 (v/v), and then raffinate of FGO (that is said non-aromatic hydrocarbons) and extracted oil were separated. The raffinate of FGO was introduced to another conventional pilot riser reactor plant as feedstock, wherein the catalytic conversion catalyst was CGP-1. In reactor zone I, the reaction temperature was 600° C., the WHSV was 100 $h^{-1}$, steam/feedstock ratio was 0.10, and the C/O was 6. In reactor zone II, the reaction temperature was 500° C., the WHSV was 20 $h^{-1}$, and the C/O was 6. The product vapors were separated to obtain dry gas, LPG, gasoline diesel and FGO which was returned to hydrotreating unit. Operating conditions and product slate were listed in table 8.

It can be seen from Table 8 that the total light hydrocarbons yield attains as high as 81.17% by weight; the gasoline yield attains as high as 38.03% by weight; the propylene yield attains as high as 7.64% by weigh; the dry gas yield is only 2.51% by weight; the slurry yield is only 1.23% by weight; the extracted oil (rich in aromatics which is good chemical resource) yield is 7.09% by weight.

Comparative Example 5

Inferior hydrogenated residue feedstock C was directly used as the feedstock of catalytic cracking and the experiment was conducted in a pilot riser reactor plant, wherein the catalyst is CGP-1, the reaction temperature was 500° C., the reaction time was 2.5 seconds, the C/O was 6, and the weight ratio of steam/the feedstock was 0.10. Reaction product vapors and the spent catalyst were separated in the disengager, and then the products were separated, wherein dry gas, LPG, gasoline, diesel and slurry were withdrawn. Operating conditions and product slate were listed in table 8.

It can be seen from Table 8 that the total light hydrocarbons yield is only 77.29% by weight; the gasoline yield is only 33.04% by weight; the propylene yield is only 7.06% by weigh; the dry gas yield attains as high as 3.63% by weight; the slurry yield attains as high as 9.77% by weight. Compared to example 7, light hydrocarbons yield decreases significantly, so the petroleum resources are underutilized.

Example 8

The experiment of the present example was carried out according to the scheme shown in FIG. 4. High acid value feedstock E was directly used as the feedstock of catalytic cracking and the experiment was conducted in a pilot riser reactor plant. Inferior feedstock E was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I were subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 18.03% by weight of the feedstock. Then the FGO was extracted with furfural, wherein the extraction temperature was 75, the Solvent/FGO ratio was 2.0 (v/v), and then raffinate of FGO (that is said non-aromatic hydrocarbons) and extracted oil were separated. The raffinate of FGO was introduced to another conventional pilot riser reactor plant as feedstock, wherein the catalytic conversion catalyst was CGP-1. In reactor zone I, the reaction temperature was 600° C., the WHSV was 100 $h^{-1}$, steam/feedstock ratio was 0.10, and the C/O was 6. In reactor zone II, the reaction temperature was 500° C., the WHSV was 20 $h^{-1}$, and the C/O was 6. The product vapors were separated to obtain dry gas, LPG, gasoline diesel and FGO which was returned to hydrotreating unit. Operating conditions and product slate were listed in table 9.

It can be seen from Table 9 that the total light hydrocarbons yield attains as high as 81.19% by weight; the gasoline yield attains as high as 36.93% by weight; the propylene yield attains as high as 7.20% by weigh; the dry gas yield is only 3.01% by weight; the extracted oil (rich in aromatics which is good chemical resource) yield is 7.08% by weight.

Comparative Example 6

High acid value feedstock E was directly used as the feedstock of catalytic cracking and the experiment was conducted in a pilot riser reactor plant, wherein the catalyst is CGP-1, the reaction temperature was 500° C., the reaction time was 2.5 seconds, the C/O was 6, and the weight ratio of steam/the feedstock was 0.10. Reaction product vapors and the spent catalyst were separated in the disengager, and then the products were separated, wherein dry gas, LPG, gasoline, diesel and slurry were withdrawn. Operating conditions and product slate were listed in table 9.

It can be seen from Table 9 that the total light hydrocarbons yield is only 77.29% by weight; the gasoline yield is only 35.43% by weight; the propylene yield is only 6.52% by weigh; the dry gas yield attains as high as 5.51% by weight; the slurry yield attains as high as 6.22% by weight. Compared to example 8, light hydrocarbons yield decreases significantly, so the petroleum resources are underutilized.

Example 9 and Example 10

The experiment of the present example was carried out according to the scheme shown in FIG. 4. Atmospheric residue feedstock B and high acid value feedstock D was directly used as the feedstock of catalytic cracking and the experiment was conducted in a pilot riser reactor plant respectively. Inferior feedstock was injected into the lower part of reaction zone I, wherein the catalytic cracking reaction was conducted by contacting catalyst GZ-1 with the feedstock. In the lower part of reactor zone I, the reaction temperature was 600° C., the WHSV was 100 $h^{-1}$, the C/O was 6, and the weight ratio of steam/the feedstock was 0.05. In reactor zone II, reacted vapors from reactor zone I were subjected to cracking reactions, wherein the reaction temperature was 500° C., the WHSV was 30 $h^{-1}$, and the weight ratio of steam/the feedstock was 0.05. Reaction product vapors and the spent catalyst were separated in the disengager, and then the products were separated, wherein dry gas, LPG, gasoline, diesel and FGO (the cutting temperature is above 330° C.) were withdrawn. The resultant FGO is in an amount of 41.90% and 34.13% by weight of the feedstock respectively. Then the FGO was extracted with furfural, wherein the extraction temperature was 75, the Solvent/FGO ratio was 2.0 (v/v), and then raffinate of FGO (that is said non-aromatic hydrocarbons) and extracted oil were separated. The raffinate of FGO was introduced to another conventional pilot riser reactor plant as feedstock, wherein the catalytic conversion catalyst was MLC-500. In reactor zone I, the reaction temperature was 600° C., the WHSV was 100 $h^{-1}$, steam/feedstock ratio was 0.05, and the C/O was 6. In reactor zone II, the reaction temperature was 500° C., the WHSV was 20 $h^{-1}$, and the C/O was 6. The product vapors were separated to obtain dry gas, LPG, gasoline diesel and FGO which was returned to hydrotreating unit. Operating conditions and product slate were listed in table 10.

It can be seen from Table 10 that both the total light hydrocarbons yield attain as high as 78.76% and 78.24% by weight respectively; both the gasoline yield attain as high as 37.73% and 41.52% by weight respectively; both the propylene yield attain as high as 4.82% and 4.05% by weight respectively; both the dry gas yield are only 2.69% and 2.81% by weight respectively; both the slurry yield are only 2.14% and 2.02% by weight respectively; both the extracted oil (rich in aromatics which are good chemical resource) yield are 8.26% and 8.23% by weight respectively.

TABLE 1

| Type of feedstock | Vacuum residue | Vacuum residue | Inferior hydrogenated residue | High acid value oil | High acid value oil |
|---|---|---|---|---|---|
| Feedstock No. | A | B | C | D | E |
| Density (20° C.), g/cm$^3$ | 920.9 | 980 | 942.7 | 932.5 | 902.2 |
| Kinematic viscosity, mm$^2$/s | | | | | |
| 80° C. | / | / | 137.7 | 156.45 | 52.5 |
| 100° C. | 114.4 | / | 62.78 | / | / |
| Carbon residue, w % | 8.2 | 13.95 | 8.0 | 6.7 | 7.89 |
| Freezing point, ° C. | 25 | / | / | / | / |
| Acid value, mgKOH/g | / | / | / | 12.52 | 3.62 |
| Total Nitrogen content, w % | 0.33 | 1.02 | / | / | 0.36 |
| Sulfur, w % | 0.21 | 1.39 | 0.24 | / | 0.14 |
| C, w % | 86.91 | 85.35 | 87.82 | / | 86.33 |
| H, w % | 12.55 | 11.14 | 12.07 | / | 12.66 |
| Metal content, ppm | | | | | |
| Ni | 8.8 | 64.0 | 7.4 | 19.3 | 61.0 |
| V | 0.1 | 5.3 | 8.2 | 1.1 | 3.4 |
| Fe | 1.8 | / | 11.1 | / | 13.2 |
| Cu | <0.1 | / | / | / | / |
| Na | 3.0 | / | 1.2 | / | 43 |
| Ca | | | 7.4 | 557 | 4.4 |
| Boiling range, ° C. | | | | | |
| IBP | 415 | / | 287 | / | / |
| 10% | 545 | / | 394 | / | / |
| 30% | / | / | 473 | / | / |
| 50% | / | / | 558 | / | / |
| 70% | / | / | / | / | / |
| 90% | / | / | / | / | / |
| FBP | / | / | / | / | / |

TABLE 2

| Catalyst No. Zeolite type | MLC-500 Large pore size | GZ-1 Medium and large pore size | CGP-1 Medium and large pore size |
|---|---|---|---|
| Chemical composition, w % | | | |
| Aluminum oxide | 50.2 | 40.0 | 56.3 |
| Sodium oxide | 0.321 | 0.29 | 0.19 |
| Iron oxide | / | 1.1 | / |
| Rare earth | | 2.5 | 3.2 |
| Apparent density, kg/m$^3$ | 700 | 750 | 630 |
| Pore volume, mL/g | 0.38 | 0.40 | 0.36 |
| Specific surface area, m$^2$/g | 229 | 196 | 221 |
| Attrition index, w % | 1.9 | 1.5 | 1.7 |
| Sieve composition, w % | | | |
| 0 ~ 40μm | 17.3 | 20.2 | 13.1 |
| 40 ~ 80μm | 49.3 | 50.1 | 41.8 |
| >80μm | 33.4 | 29.7 | 45.1 |

TABLE 3

| | Example 1 | Comparative example 1 |
|---|---|---|
| Feedstock No. | A | A |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II, $h^{-1}$ | 100/30 | / |
| C/O ratio by weight | 6 | / |
| Steam/Feedstock ratio ,m/m | 0.05 | / |
| The percentage of FGO having a cutting point above 330° C. by the weight of the feedstock | 24.48 | |
| Hydrotreating unit | | |
| hydrogen partial pressure, MPa | 18.0 | |
| Temperature, ° C. | 350 | / |
| Volume hourly space yelocity, $h^{-1}$ | 1.5 | / |
| Hydrogen/feedstock ratio,v/v | 1500 | / |
| Conventional FCC unit | | |
| Catalyst | MLC-500 | MLC-500 |
| Riser outlet temperature, ° C. | / | 500 |
| Temperature of reactor zone I/II, ° C. | 600/500 | / |
| WHSV, $h^{-1}$ or Reaction time, s | 100/20 1$h^{-1}$ | 2.5 s |
| Steam/Feedstock ratio ,m/m | / | 0.05 |
| C/O ratio by weight | 6 | 6 |
| Product distribution, w % | | |
| Dry gas | 2.62 | 3.49 |
| LPG | 15.62 | 13.50 |
| Propylene | 5.05 | 4.21 |
| Gasoline | 51.75 | 43.76 |
| Diesel | 21.02 | 20.18 |

TABLE 3-continued

| | Example 1 | Comparative example 1 |
|---|---|---|
| Slurry | 1.10 | 9.18 |
| Coke | 7.89 | 9.89 |
| Total | 100 | 100.0 |
| Total light hydrocarbons yield, w % | 88.39 | 77.44 |
| Octane number | | |
| RON | 91.2 | 91.0 |
| MON | 80.0 | 78.1 |

TABLE 4

| | Example 2 | Comparative example 2 |
|---|---|---|
| Feedstock No. | C | C |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II,h-1 | 100/30 | / |
| C/O ratio by weight | 6 | 6 |
| Steam/Feedstock ratio ,m/m | 0.05 | / |
| The percentage of FGO having a cutting point above 330° C. by the weight of the feedstock | 38.57 | |
| Hydrotreating unit | | |
| hydrogen partial pressure, MPa | 18.0 | |
| Temperature, ° C. | 350 | / |
| Volume hourly space velocity, $h^{-1}$ | 1.5 | / |
| Hydrogen/feedstock ratio,v/v | 1500 | / |
| Conventional FCC unit | | |
| Catalyst | CGP-1 | CGP-1 |
| Riser outlet temperature, ° C. | 500 | 500 |
| Temperature of reactor zone I/II, ° C. | 600/500 | |
| WHSV, $h^{-1}$ or Reaction time, s | 100/20 $h^{-1}$ | 2.5 s |
| C/O ratio by weight | 6 | 6 |
| Steam/Feedstock ratio ,m/m | 0.10 | 0.10 |
| Product distribution, w % | | |
| Dry gas | 2.68 | 3.63 |
| LPG | 22.32 | 20.17 |
| Propylene | 8.04 | 7.06 |
| Gasoline | 41.35 | 33.04 |
| Diesel | 23.82 | 24.08 |
| Slurry | 1.30 | 9.77 |
| Coke | 8.53 | 9.31 |
| Total | 100 | 100.0 |
| Total light hydrocarbons yield, w % | 87.49 | 77.29 |
| Octane number | | |
| RON | 94.5 | 94.0 |
| MON | 84.0 | 83.1 |

TABLE 5

| | Example 3 | Comparative example 3 |
|---|---|---|
| Feedstock No. | E | E |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II, $h^{-1}$ | 100/30 | / |
| C/O ratio by weight | 6 | / |
| Steam/Feedstock ratio ,m/m | 0.05 | / |
| The percentage of FGO having a cutting point above 330° C. by the weight of the feedstock | 18.03 | / |
| Hydrotreating unit | | |

TABLE 5-continued

| | Example 3 | Comparative example 3 |
|---|---|---|
| hydrogen partial pressure, MPa | 18.0 | |
| Temperature, ° C. | 350 | / |
| Volume hourly space velocity, $h^{-1}$ | 1.5 | / |
| Hydrogen/feedstock ratio,v/v | 1500 | / |
| Conventional FCC unit | | |
| Catalyst | CGP-1 | CGP-1 |
| Riser outlet temperature, ° C. | 500 | 500 |
| Temperature of reactor zone I/II, ° C. | 600/500 | |
| WHSV, $h^{-1}$ or Reaction time, s | 100/20 $h^{-1}$ | 2.5 s |
| C/O ratio by weight | 6 | 6 |
| Steam/Feedstock ratio, m/m | 0.10 | 0.10 |
| Product distribution, w % | | |
| Dry gas | 3.21 | 5.51 |
| LPG | 21.62 | 19.10 |
| Propylene | 7.57 | 6.52 |
| Gasoline | 40.17 | 35.43 |
| Diesel | 25.72 | 22.76 |
| Slurry | / | 6.22 |
| Coke | 8.50 | 10.16 |
| Oxygenated compounds | 0.78 | 0.82 |
| Total | 100.00 | 100.00 |
| Total light hydrocarbons yield, w % | 87.51 | 77.29 |
| Octane number | | |
| RON | 91.0 | 90.0 |
| MON | 80.0 | 78.8 |

TABLE 6

| | Example 4 | Example 5 |
|---|---|---|
| Feedstock No. | B | D |
| Reactor | Cascade riser | Cascade riser |
| Catalytic cracking unit | | |
| Operation condition | | |
| Catalyst | GZ-1 | GZ-1 |
| Riser outlet temperature, ° C. | 500 | 500 |
| Temperature of reactor zone I/II, ° C. | 600/500 | 600/500 |
| WHSV of reactor zone I/II, $h^{-1}$ | 100/30 | 100/30 |
| C/O ratio by weight | 6 | 6 |
| Steam/Feedstock ratio, m/m | 0.05 | 0.05 |
| The percentage of FGO having a cutting point above 330° C. by the weight of the feedstock | 41.90 | 34.13 |
| Hydrotreating unit | | |
| hydrogen partial pressure, MPa | 18.0 | 18.0 |
| Temperature, ° C. | 350 | 350 |
| Volume hourly space velocity, $h^{-1}$ | 1.5 | 1.5 |
| Hydrogen/feedstock ratio,v/v | 2000 | 2000 |
| Conventional FCC unit | | |
| Catalyst | MLC-500 | MLC-500 |
| Riser outlet temperature, ° C. | 500 | 500 |
| Temperature of reactor zone I/II, ° C. | 600/500 | 600/500 |
| WHSV of reactor zone I/II, $h^{-1}$ | 100/20 | 100/20 |
| C/O ratio by weight | 6 | 6 |
| Steam/Feedstock ratio, m/m | 0.05 | 0.05 |
| Product distribution, w % | | |
| Dry gas | 2.89 | 3.03 |
| LPG | 13.23 | 13.50 |
| Propylene | 5.05 | 4.21 |
| Gasoline | 41.63 | 45.76 |
| Diesel | 31.16 | 26.18 |
| Slurry | 2.30 | 2.18 |
| Coke | 8.89 | 9.03 |
| Total | 100 | 99.68 |
| Total light hydrocarbons yield, w % | 86.02 | 85.44 |
| Octane number | | |
| RON | 96.0 | 92.6 |
| MON | 84.0 | 81.1 |

TABLE 7

| | Example 6 | Comparative example 4 |
|---|---|---|
| Feedstock No. | A | A |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II, $h^{-1}$ | 100/30 | / |
| C/O ratio by weight | 6 | / |
| Steam/Feedstock ratio ,m/m | 0.05 | / |
| The percentage of FGO having a cutting point above 330° C. by the weight of the feedstock | 24.48 | |
| Solvent extraction unit | | |
| Temperature, ° C. | 75 | / |
| Solvent | Furfural | / |
| Solvent/ FGO, v/v | 2 | / |
| Conventional FCC unit | | |
| Catalyst | MLC-500 | MLC-500 |
| Riser outlet temperature, ° C. | / | 500 |
| Temperature of reactor zone I/II, ° C. | 600/500 | / |
| WHSV, h-1 or Reaction time, s | 100/20 $h^{-1}$ | 2.5 s |
| C/O ratio by weight | / | 6 |
| Steam/Feedstock ratio, m/m | / | 0.05 |
| Product distribution, w % | | |
| Dry gas | 2.48 | 3.49 |
| LPG | 14.96 | 13.50 |
| Propylene | 4.86 | 4.21 |
| Gasoline | 47.69 | 43.76 |
| Diesel | 19.37 | 20.18 |
| Slurry | 1.04 | 9.18 |
| Coke | 7.41 | 9.89 |
| Extracted oil | 7.06 | / |
| Total | 100.00 | 100.0 |
| Total light hydrocarbons yield, w % | 82.01 | 77.44 |
| Octane number | | |
| RON | 91.0 | 91.0 |
| MON | 79.8 | 78.1 |

TABLE 8

| | Example 7 | Comparative example 5 |
|---|---|---|
| Feedstock No. | C | C |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II, $h^{-1}$ | 100/30 | / |
| C/O ratio by weight | 6 | / |
| Steam/Feedstock ratio, m/m | 0.05 | / |
| The percentage of FGO having a cutting point above 330° C. by the weight of the feedstock | 38.57 | / |
| Solvent extraction unit | | |
| Temperature, ° C. | 75 | / |
| Solvent | Furfural | / |
| Solvent/ FGO, v/v | 2 | / |
| Conventional FCC unit | | |
| Catalyst | CGP-1 | CGP-1 |
| Riser outlet temperature, ° C. | 500 | 500 |
| Temperature of reactor zone I/II, ° C. | 600/500 | |
| WHSV, $h^{-1}$ or Reaction time, s | 100/20 $h^{-1}$ | 2.5 s |
| C/O ratio by weight | 6 | 6 |
| Steam/Feedstock ratio, m/m | 0.10 | 0.10 |
| Product distribution, w % | | |
| Dry gas | 2.51 | 3.63 |
| LPG | 21.17 | 20.17 |
| Propylene | 7.64 | 7.06 |

TABLE 8-continued

| | Example 7 | Comparative example 5 |
|---|---|---|
| Gasoline | 38.03 | 33.04 |
| Diesel | 21.97 | 24.08 |
| Slurry | 1.23 | 9.77 |
| Coke | 7.09 | / |
| Extracted oil | 8.00 | 9.31 |
| Total | 100.00 | 100.0 |
| Total light hydrocarbons yield, w % | 81.17 | 77.29 |
| Octane number | | |
| RON | 94.5 | 94.0 |
| MON | 83.7 | 83.1 |

TABLE 9

| | Example 8 | Comparative 6 |
|---|---|---|
| Feedstock No. | E | E |
| Reactor | Cascade riser | Riser |
| Catalytic cracking unit | | |
| Operation condition | | |
| Catalyst | GZ-1 | / |
| Riser outlet temperature, ° C. | 500 | / |
| Temperature of reactor zone I/II, ° C. | 600/500 | / |
| WHSV of reactor zone I/II, $h^{-1}$ | 100/30 | / |
| C/O ratio by weight | 6 | / |
| Steam/Feedstock ratio, m/m | 0.05 | / |
| The percentage of FGO having a cutting point above 330° C. by the weight of the feedstock | 18.03 | / |
| Solvent extraction unit | | |
| Temperature, ° C. | 75 | / |
| Solvent | Furfural | / |
| Solvent/ FGO, v/v | 2 | / |
| Conventional FCC unit | | |
| Catalyst | CGP-1 | CGP-1 |
| Riser outlet temperature, ° C. | 500 | 500 |
| Temperature of reactor zone I/II, ° C. | 600/500 | |
| WHSV, $h^{-1}$ or Reaction time, s | 100/20 $h^{-1}$ | 2.5 s |
| C/O ratio by weight | 6 | 6 |
| Steam/Feedstock ratio, m/m | 0.10 | 0.10 |
| Product distribution, w % | | |
| Dry gas | 3.01 | 5.51 |
| LPG | 20.52 | 19.10 |
| Propylene | 7.20 | 6.52 |
| Gasoline | 36.93 | 35.43 |
| Diesel | 23.74 | 22.76 |
| Slurry | / | 6.22 |
| Oxygenated compounds | 0.75 | 0.82 |
| Extracted oil | 7.08 | |
| Coke | 7.97 | 10.16 |
| Total | 100.00 | 100.00 |
| Total light hydrocarbons yield, w % | 81.19 | 77.29 |
| Octane number | | |
| RON | 91.0 | 90.0 |
| MON | 80.0 | 78.8 |

TABLE 10

| | Example 9 | Example 10 |
|---|---|---|
| Feedstock No. | B | D |
| Reactor | Cascade riser | Cascade riser |
| Catalytic cracking unit | | |
| Operation condition | | |
| Catalyst | GZ-1 | GZ-1 |
| Riser outlet temperature, ° C. | 500 | 500 |
| Temperature of reactor zone I/II, ° C. | 600/500 | 600/500 |
| WHSV of reactor zone I/II, $h^{-1}$ | 100/30 | 100/30 |
| C/O ratio by weight | 6 | / |
| Steam/Feedstock ratio, m/m | 0.05 | 0.05 |
| The percentage of FGO having a cutting point above 330° C. by the | 41.90 | 34.13 |

TABLE 10-continued

| | Example 9 | Example 10 |
|---|---|---|
| weight of the feedstock | | |
| Solvent extraction unit | | |
| Temperature, ° C. | 75 | 75 |
| Solvent | Furfural | Furfural |
| Solvent /FGO, v/v | 2 | 2 |
| Conventional FCC unit | | |
| Catalyst | MLC-500 | MLC-500 |
| Riser outlet temperature, ° C. | 500 | 500 |
| Temperature of reactor zone I/II, ° C. | 600/500 | 600/500 |
| WHSV of reactor zone I/II, $h^{-1}$ | 100/20 | 100/20 |
| C/O ratio by weight | 6 | 6 |
| Steam/Feedstock ratio, m/m | 0.05 | 0.05 |
| Product distribution, w % | | |
| Dry gas | 2.69 | 2.81 |
| LPG | 12.63 | 12.88 |
| Propylene | 4.82 | 4.05 |
| Gasoline | 37.73 | 41.52 |
| Diesel | 28.40 | 23.83 |
| Slurry | 2.14 | 2.01 |
| Extracted oil | 8.26 | 8.23 |
| Coke | 8.16 | 8.37 |
| Oxygenated compounds | | 0.33 |
| Total | 100.00 | 100.00 |
| Total light hydrocarbons yield, w % | 78.76 | 78.24 |
| Octane number | | |
| RON | 95.8 | 92.6 |
| MON | 83.7 | 81.0 |

All the references described above are incorporated by reference for all useful purposes.

While there is shown and described certain specific embodiments embodying the invention, it will be manifest to those skilled in the art that various modifications and changes may be made without departing from the spirit and scope of the underlying inventive concept and that the same is not limited to the particular forms herein illustrated.

The invention claimed is:

1. A process for converting inferior feedstock to high quality fuel oil, characterized in that the process comprises the steps as follow:

(1) a preheated inferior feedstock is introduced into a first reactor zone in a catalytic conversion reactor and is subjected to catalytically cracking reactions by contacting with a catalytic conversion catalyst; the produced vapors and used catalyst, which are optionally mixed with light feedstocks and/or quench mediums, are introduced into a second reactor zone in the catalytic conversion reactor for further cracking, hydrogen transferring and isomerizing reactions; the resultant reaction products are separated from the spent catalyst by gas-solid separation, and then the reaction products are introduced into a separation system to obtain dry gas, LPG, gasoline, diesel and fluid catalytic cracking gas oil (FGO); optionally, the spent catalyst is stripped by steam, and then fed into a regenerator to be regenerated by burning off the coke, and then the heated regenerated catalyst is recycled to the reactor; wherein the reaction conditions in said first and second reactor zones reaction are sufficient to achieve a yield of FGO between 12% and 60% by weight of the feedstock;

(2) said FGO is introduced into a hydrotreating unit and/or an aromatics extraction unit to obtain hydrotreated FGO and/or a raffinate of FGO;

(3) said hydrotreated FGO and/or the raffinate of FGO are recycled to the first reactor zone in the catalytic conversion reactor and/or other FCC units for further reactions to obtain the target product high quality fuel oil, wherein the cutting temperature of said FGO is not less than 250° C., and the hydrogen content of FGO is not less than 10.5% by weight.

2. The process according to claim 1, characterized in that said inferior feedstock is selected from heavy petroleum hydrocarbons and/or other mineral oils, wherein the petroleum hydrocarbon is one selected from the group consisting of vacuum residue, inferior atmospheric residue, inferior hydrotreated residue, coker gas oil, deasphalted oil, high acid value content crude oil and high metal content crude oil or mixtures thereof, and the other mineral oil is one selected from the group consisting of coal liquefied oil, tar sand oil and shale oil or mixtures thereof.

3. The process according to claim 1, characterized in that said inferior feedstock meets at least one of the following criteria: a density from 900 kg/$m^3$ to 1000 kg/$m^3$, a carbon residue from 4 w % to 15 w %, a metal contents from 15 ppm to 600 ppm, and an acid value from 0.5 mgKOH/g to 20 mgKOH/g.

4. The process according to claim 3, characterized in that said inferior feedstock meets at least one of the following criteria: a density from 930 kg/$m^3$ to 960 kg/$m^3$, a carbon residue from 6 w % to 12 w %, a metal content from 15 ppm to 100 ppm, and an acid value from 0.5 mgKOH/g to 10 mgKOH/g.

5. The process according to claim 1, characterized in that said reaction conditions in the first and second reactor zone are sufficient to achieve a yield of FGO between 20% and 40% by weight of said feedstock.

6. The process according to claim 1, characterized in that said light feedstock is one selected from LPG, gasoline and diesel or mixtures thereof.

7. The process according to claim 1, characterized in that said quench medium is one selected from quench agent, cooled regenerated catalyst, semi-regenerated catalyst, spent catalyst and fresh catalyst or mixtures thereof, wherein said quench agent is one selected from the group consisting of LPG, naphtha, stabilized gasoline, diesel, heavy diesel and water or mixtures thereof; said cooled regenerated catalyst and semi-regenerated catalyst are obtained by cooling the catalyst through a catalyst cooler after the catalyst being regenerated by two-stage and one-stage regeneration respectively.

8. The process according to claim 1, characterized in that said catalytic conversion catalyst comprises zeolites, inorganic oxides and optional clays, which account for the following percent of the total weight of the catalyst respectively: zeolites 1~50% by weight, inorganic oxides 5~99% by weight, and clays 0~70% by weight, wherein said zeolites as active components are medium pore size zeolites and optional large pore zeolites, said medium pore size zeolites are selected from ZSM series zeolites and/or ZRP zeolites, and said large pore size zeolites are selected from the group consisting of rare-earth Y, rare-earth HY, ultra-stable Y and high silica Y or mixtures thereof.

9. The process according to claim 1, characterized in that the conditions in said first reactor zone comprise: a reaction temperature from 510° C. to 650° C., a weight hourly space velocity from 10 $h^{-1}$ to 200 $h^{-1}$, a weight ratio of the catalyst to the feedstock from 3:1 to 15:1, a weight ratio of the steam to the feedstock from 0.03:1 to 0.3:1, and a reaction pressure from 130 kPa to 450 KPa.

10. The process according to claim 9, characterized in that the conditions in said first reactor zone comprise: a reaction temperature from 520° C. to 600° C., a WHSV from 15 $h^{-1}$ to 150 $h^{-1}$, a weight ratio of the catalyst to the feedstock from 4:1 to 12:1, a weight ratio of the steam to the feedstock from 0.05:1 to 0.2:1, and a reaction pressure from 130 kPa to 450 kPa.

11. The process according to claim 1, characterized in that the conditions in said second reactor zone comprise: a reaction temperature from 420° C. to 550° C., and a WHSV from 5 $h^{-1}$ to 150 $h^{-1}$.

12. The process according to claim 11, characterized in that the conditions in said second reactor zone comprise: a reaction temperature from 460° C. to 530° C., and a WHSV from 15 $h^{-1}$ to 80 $h^{-1}$.

13. The process according to claim 1, characterized in that at least one selected from the group consisting of propane in the LPG, C4 hydrocarbons in the LPG, and diesel is recycled to said second reactor zone as the light feedstock.

14. The process according to claim 1, characterized in that the solvent for said extraction is one selected from dimethyl sulfoxide, furfural, dimethylformamide, monoethanolamine, ethylene glycol and 1,2-propanediol or mixture thereof, said extraction temperature is from 40° C. to 120° C., and said solvent/FGO ratio is from 0.5:1 to 5.0:1 by volume.

15. The process according to claim 1, characterized in that the FGO is hydrotreated in the presence of hydrogen gas by contacting with a hydrotreating catalyst at the following conditions: hydrogen partial pressure 3.0 MPa~20.0 MPa, reaction temperature 300° C.~450° C., hydrogen/oil ratio 300~2000 by volume, and volume hourly space velocity 0.1 $h^{-1\sim3.0}$ $h^{-1}$.

16. The process according to claim 1, characterized in that cutting temperature of said FGO is not less than 330° C., hydrogen content of FGO is not less than 10.8% by weight.

17. The process according to claim 8, characterized in that said medium pore size zeolite accounts for 0~50% of the total weight of the zeolite.

18. The process according to claim 17, characterized in that said medium pore size zeolite accounts for 0~20% of the total weight of the zeolite.

19. The process according to claim 1, characterized in that said reactor is one selected from a riser, an iso-linear speed fluidized bed, an iso-diameter fluidized bed, a descending transfer line and an ascending transfer line or a combination thereof, or a combination of two or more same reactors, wherein said combination includes cascade and/or parallel, wherein said riser is selected from conventional risers with iso-diameter or various risers with varied diameters.

20. The process according to claim 19, characterized in that said reactor is a riser with varied diameters.

* * * * *